United States Patent [19]

Hwang

[11] 4,132,674

[45] Jan. 2, 1979

[54] ELECTROCONDUCTIVE COATING FORMULATION

[75] Inventor: Mei H. Hwang, Pittsburgh, Pa.

[73] Assignee: Calgon Corporation, Pittsburgh, Pa.

[21] Appl. No.: 862,997

[22] Filed: Dec. 21, 1977

[51] Int. Cl.[2] ..... H01B 1/00

[52] U.S. Cl. ..... 252/500; 96/1.5 R

[58] Field of Search ..... 252/500; 260/567.6 M; 96/1.5 R

[56] References Cited

U.S. PATENT DOCUMENTS 3,953,374 4/1976 Windhager ..... 252/500 X

FOREIGN PATENT DOCUMENTS 1434119 5/1976 United Kingdom.

*Primary Examiner*—Benjamin R. Padgett
*Assistant Examiner*—E. Suzanne Parr
*Attorney, Agent, or Firm*—Martin L. Katz; Mario A. Monaco

[57] ABSTRACT

Methanol soluble electroconductive coating formulations comprising an electroconductive polymer and a methanol dispersible fluorosurfactant and optionally a pigment.

4 Claims, No Drawings

ELECTROCONDUCTIVE COATING FORMULATION

This invention relates to a methanol soluble electroconductive coating formulation having improved solvent holdout properties.

More particularly, this invention relates to an electroconductive coating composition which comprises an electroconductive polymer, a methanol soluble fluorosurfactant and a pigment, if desired. This formulation may be applied by conventional methanol based systems while providing improved solvent holdout properties.

In general, electroconductive base sheets for use in the manufacture of electrophotographic reproduction papers or electrographic dielectric papers are prepared by applying to one or both surfaces of a suitable paper substrate (a publication grade paper of basis weight in the range of 30 to 45 pounds per 3,000 square feet) a resinous conductive layer to render the paper electroconductive. Commonly the conductive layer comprises an electroconductive polymer either alone or more usually, formulated with a binder and with a pigment (such as calcium carbonate, kaolin clay, titanium dioxide, alumina or a combination of these materials). In the electrophotographic reproduction paper or electrographic dielectric paper industry, such formulations including a conductive agent, a binder and a pigment are commonly referred to as coating color formulations or compositions.

The binders in conventional conductive coating color formulations serve to make the paper less porous more uniform, to improve the adherence of the conductive layer to the base paper and, importantly, to impart to the conductive layer the properties of a holdout or barrier coating to prevent solvents employed in the later applied photosensitive zinc oxide or dielectric layers from penetrating into the conductivized paper. A separate non-conductive solvent holdout layer comprising one or a mixture of conventional binders is applied to the paper prior to the application of the conductive layer in order to assist in achieving a solvent holdout effect. Solvent holdout to both toluene and parafinic solvents is essential because the top side of a conductive base paper comes into contact with toluene during the subsequent application of the photosensitive or dielectric coating which comprises dye-sensitized zinc oxide or dielectric resin and pigment dispersed in a solution to toluene and a binder. The back side of the zinc oxide or dielectric coated paper (now referred to as finished Electrofax or dielectric paper) comes into contact with kerosene during the copying process inside Electrofax copy or electrostatic writing machines that use "wet" toners which are commonly comprised of carbon particles suspended in a solution of kerosene and binders. The usual type of electroconductive polymer in combination with the usual type of coating color additives, such as the binders and pigments mentioned above, will not give acceptable solvent holdout when applied at commercially feasible coatweights of from 0.5 to 4 pounds of coating per 3,000 square feet per paper surface where attempts are made to prepare the conductive base sheet in an obviously desirable one-pass process without pretreatment of the paper raw stock with a separate solvent holdout layer.

Such water-based systems having improved solvent holdout properties are described in U.S. Pat. No. 3,953,374 where water-soluble fluorocarbons were utilized to impart improved solvent holdout properties to electroconductive coating formulations. However, in many situations it is desirable to utilize methanol based coating formulations for a variety of reasons and the water-soluble fluorocarbons described in the above-mentioned patent are not satisfactory.

Accordingly, the instant invention is based upon Applicant's discovery that the solvent holdout properties of conventional methanol soluble coating color formulations can be markedly enhanced by incorporating into such formulations an effective quantity of a methanol soluble or dispersible fluorosurfactant of the type hereinafter described without the necessity of utilizing a binder or other additives. Applicant has found that the improved coating color formulations of this invention will give to the conductive base sheet surface resistivity, zinc oxide or dielectric topcoatability, rebrokability of broke and enhanced solvent holdout properties that are commercially acceptable for the manufacture of electrophotographic reproduction or electrographic dielectric papers according to current industry standards and practices, when applied to a non-surface sized raw stock (a raw stock that has no surface treatment of starch, alginate or other surface sizing material). The improved coating color formulations of this invention therefore, not only provide enhanced solvent holdout properties, but make possible the application of the electroconductive layer to the base sheet in a one-pass operation thus eliminating any necessity for the application of separate solvent holdout layers. The surface resistivity, zinc oxide and dielectric topcoatability, rebrokability and solvent holdout properties obtained through the use of the improved coating color formulations of this invention have been confirmed employing standard laboratory techniques. It is contemplated, therefore, that suitable coatweights of the improved coating color formulations of this invention will be employed in the manufacture of electroconductive base sheets suitable for the preparation of electrophotographic and electrographic reproduction and printing papers.

The nature of the electroconductive polymer component of the improved coating color formulations of this invention is not critical. Any of a variety of electroconductive polymers, both cationic and anionic, may be employed provided that the conductive polymer selected is capable of imparting adequate surface resistivity to the base raw stock (industry requirements for conductivity in base sheets are $10^8$–$10^{10}$ [ohms per square] decade at 15% relative humidity). As cationic electroconductive polymers, there may be employed any water soluble cationic polymer containing quaternary ammonium functional groups. Included in such cationic polymers are those wherein the quaternary ammonium functional group is carried as a pendant group to the principal polymer chain, such as, for example, polyvinyl benzyl trimethyl ammonium chloride, poly-[alpha-(methylene trimethyl ammonium chloride) ethylene oxide] and poly methacryloloxyethyl trimethyl ammonium chloride; those wherein the quaternary ammonium functional group is incorporated in a cyclic structure which comprises a portion of the polymer backbone, such as for example, poly-(dimethyldiallyl ammonium chloride); and those wherein the quaternary ammonium functional group forms a part of the polymer chain, such cationic polymers being commonly designated as "ionenes".

Included in this group, for example, are ionene polymers prepared from halo alkyl dialkyl amine monomer units, such as 3-ionene(poly-(dimethyl propyl)-ammonium chloride), prepared by the polymerization of 3-chloropropyl dimethyl amine, and ionene polymers prepared from di-tertiaryamines and dihalides, such as 3,4-ionene which is prepared from 1,3-bis-dimethylamino propane and 1,4-dichlorobutene. Other ionene polymers, of course, which are prepared similarly may be employed as the electroconductive component of the coating color formulations of this invention.

In addition to the cationic electroconductive polymers mentioned above, water soluble cationic phosphonium and sulfonium polymers also may be employed as the electroconductive component in the coating color formulations of this invention. Included among these are polymers such as, for example, poly-(2-acryloxyethyldimethyl sulfonium chloride) and poly-(glycidyltributyl phosphonium chloride) and the like.

Water soluble anionic polymers useful in the preparation of the coating color formulations of this invention typically are polymeric acids and alkali metal and alkaline earth metal salts. Included among such anionic polymers are, for example, poly(sulfostyrene), poly(allyl sulfonic)acid, sulfonated urea-formaldehyde resin sulfonated polymethylolacrylamide and the like.

It should be noted that the typical cationic and anionic polymers mentioned above may contain one or more other mer units. For example, copolymers such as the copolymer of dimethyl diallyl ammonium chloride and diacetone acrylamide or the copolymer of styrene and maleic acid also can be used as the electroconductive component of the coating color formulations of this invention. The ratio of mer units in such copolymers will be determined by the quantity of cationic or anionic necessary to impart the desired surface resistivity to the base sheet.

Although any of the electroconductive polymers noted above, or other electroconductive polymers capable of imparting the necessary degree of surface resistivity to the base sheet, may be employed as the electroconductive component in the improved coating color formulations of this invention, the preferred electroconductive polymers are the cationic polymers and copolymers and especially cationic quaternary ammonium polymers and copolymers. Of these the most preferred polymers are poly-(dimethyldiallylammonium chloride), copolymers of dimethyl diallyl ammonium chloride and diacetone acrylamide containing from 70 to 98% diallyl monomer, polyvinyl benzyl trimethyl ammonium chloride, poly-methacryloloxyethyl trimethyl ammonium chloride, polymethacryloloxytrimethylammonium methosulfate, polyepichlorohydrin 80 to 100% quaternized with trimethylamine, copolymers of acrylamide and methacryloloxyethyl trimethyl ammonium chloride containing from 90 to 99.5% methacryloloxyethyl monomer and poly-(methacryloloxyethyl dimethyl hydroxyethyl ammonium chloride).

Any of the variety of pigments conventionally employed in coating color formulations may be employed in the improved color coating formulations of this invention including commercially available calcium carbonates, kaolin clays, titanium dioxides, aluminas or combinations of these materials.

Applicant has found that certain methanol soluble fluorosurfactants are essential to achieving the improved solvent holdout properties displayed by the coating formulations of this invention. The fluorosurfactants useful in the present invention have the advantages of being low foaming, effective at low concentrations and unaffected by the pigments used in the formulation or hardness of water. These fluorosurfactants may be represented by the formula:

$$F(CF_2)_nCH_2CH_2SCH_2CH_2N^+R_1R_2R_3$$

wherein:

n is an integer of from 4 to 14;

$R_1$ is an alkyl group of 1 to 4 carbon atoms;

$R_2$ is an alkyl group of 1 to 4 carbon atoms; and $R_3$ is an alkyl group of 1 to 4 carbon atoms or is the covalently bonded anion.

Particularly preferred are the surfactants manufactured by E. I. du Pont de Nemours Company, Inc., Wilmington, Del., under the trademarks ZONYL FSB and ZONYL FSC which are:

ZONYL FSB:

$$F(CF_2)_nCH_2CH_2SCH_2CH_2N^+(CH_3)_2CH_2CO\text{-}O^-$$

ZONYL FSC:

$$F(CF_2)_nCH_2CH_2SCH_2CH_2N^+(CH_3)_2$$

wherein n is an integer of from 4 to 14.

In order to use the fluorosurfactants described in U.S. Pat. No. 3,953,374 in accordance with the teachings of the instant invention, it is first necessary to make an aqueous mixture of the conductive polymer and the fluorocarbon, dry the mixture and then disperse the dried mixture in methanol for use. This technique is not practical for commercial use, and accordingly, the methanol solubility of the fluorosurfactants of the instant invention is extremely advantageous.

The weight percent (dry coating) of the several components of the coating formulations of this invention may vary widely. In general, the electroconductive polymer component will constitute from 60 to about 99% by weight of the formulation, the pigment will constitute from 0 to about 40% by weight of the formulation and the fluorosurfactant will constitute from about 0.5 to about 10% by weight of the formulation. The formulations of this invention may be applied in coatweights of from about 0.5 lbs./3000 ft.$^2$ to about 4 lbs./3000 ft.$^2$ depending on the intended application.

In order to illustrate the advantages derived from the use of the improved coating color formulations of this invention, coating color formulations containing fluorosurfactants in accordance with the instant invention and coating color formulations containing no fluorosurfactant were coated as aqueous emulsions on both sides of raw stock. The raw stock sheets were coated via draw downs with the appropriate wire-wound rod according to standard lab practices. The sheets were dried in a photographic print dryer for 15 seconds after coating.

A portion of the sheet, after conditioning at 50% relative humidity for at least 4 hours, was evaluated for solvent holdout by contacting the sheet with the appropriate solvent/dye solution (toluene plus 2% flaming red dye) for 10 seconds, immediately wiping the dye solvent from the sheet, visually inspecting the other side and estimating the penetration. Estimation of holdout was based on the reference chart used in the TAPPI (Technical Association of the Pulp and Paper Industry) New Provisional Method T-528. Another portion of the sheet was also tested after conditioning at 15% relative humidity, at least overnight, for surface resistivity using a 3.375 inch diameter disc from the sheet and a Keithley 610B Electrometer. Results of typical experiments are set forth below.

TABLE I

Solvent Holdout Evaluation of Conductive Coating Formulations

| | Coating Formulation | Coat-Weight Lbs./3000 Ft.$^2$ | % Flaming Red Penetration Top | % Flaming Red Penetration Back |
|---|---|---|---|---|
| 1. | 98/2 Polymer 261LV/Zonyl FSC (In Methanol) | 2.3 | 0 | 0 |
| 2. | 98/2 Polymer 261LV/Zonyl FSC (In Water) | 2.3 | 6 | 10 |
| 3. | 98/2 Polymer 261LV/Zonyl FSC (In Methanol) | 1.5 | 90 | 90 |
| 4. | 98/2 Polymer 261LV/Zonyl FSC (In Methanol) | 1.8 | 90 | 90 |
| 5. | 98/2 Polymer 261LV/Zonyl FSC (In Methanol) | 2.5 | 10 | 30 |
| 6. | 98/2 Polymer 261LV/Zonyl FSC (In Water) | 2.5 | 100 | 100 |
| 7. | 98/2 Polymer 261LV/Zonyl FSB (In Methanol) | 2.3 | 0 | 0 |
| 8. | 98/2 Polymer 261LV/Zonyl FSB (In Water) | 2.3 | 0 | 0 |
| 9. | 98/2 Polymer 261LV/Zonyl FSB (In Water) | 2.5 | 90 | 90 |
| 10. | 98/2 Polymer 261LV/Zonyl FSB (In Methanol) | 2.5 | 2 | 4 |
| 11. | 98/2 Polymer 261LV/Zonyl FSB (In Methanol) | 2.0 | 8 | 30 |
| 12. | 99/1 Polymer 261LV/Zonyl FSB (In Methanol) | 2.5 | 50 | 80 |
| 13. | 98/2 Polymer 261LV/Zonyl FSB (In Methanol) | 2.5 | 2 | 2 |
| 14. | 98/2 Polymer 261LV/Zonyl FSB (In Methanol) | 2.5 | 2 | 2 |
| 15. | 98/2 Polymer 261LV/Zonyl FSB (In Water) | 2.5 | 50 | 80 |
| 16. | 98/2 Polymer 261LV/Zonyl FSB (In Methanol) | 1.9 | 70 | 70 |
| 17. | 98/2 Polymer 261LV/Zonyl FSB (In Methanol) | 1.6 | 60 | 90 |
| 18. | 98/2 Polymer 261LV/Zonyl FSB (In Methanol) | 1.9 | 50 | 80 |
| 19. | 98/2 Polymer 261LV/Zonyl FSB (In Methanol) | 2.3 | 20 | 60 |
| 20. | 98/2 Polymer 261LV/Zonyl FSB (In methanol) | 3.1 | 0 | 10 |
| 21. | 98/2 Polymer 261LV/Zonyl FSB (In Methanol) | 3.3 | 0 | 2 |

Polymer 261LV is a low viscosity homopolymer of dimethyl diallyl ammonium chloride.

TABLE III-continued

Conductivity and Solvent Holdout Properties of Raw Stock Coated with Polymer 261LV/Zonyl FSB/Atomite in Methanol Solution

| | Coating Formulation | Coat-weight Lbs./3000 Ft.$^2$ | Surface Resistivity at 50% R.H. (Ohms/Square) | % Flaming Red Penetration |
|---|---|---|---|---|
| 3. | 100% 99% Polymer 261LV 1% Zonyl FSB | 1.0 | $8.2 \times 10^7$ | 0 |
| 4. | 100% 99% Polymer 261LV 1% Zonyl FSB | 1.2 | $4.9 \times 10^7$ | 0 |
| 5. | 100% 93% Polymer 261LV 2% Zonyl FSB 5% Atomite | 0.9 | $8.8 \times 10^7$ | 0 |
| 6. | 100% 93% Polymer 261LV 2% Zonyl FSB 5% Atomite | 1.2 | $6.1 \times 10^7$ | 0 |
| 7. | 100% 94% Polymer 261LV 1% Zonyl FSB 5% Atomite | 0.9 | $7.7 \times 10^7$ | 2 |
| 8. | 100% 94% Polymer 261LV 1% Zonyl FSB 5% Atomite | 1.2 | $5.3 \times 10^7$ | 2 |
| 9. | 100% 100% Polymer 261LV | 1.0 | $9.9 \times 10^7$ | 60 |
| 10. | 100% Polymer 261LV | 1.2 | $7.3 \times 10^7$ | 40 |
| 11. | 100% Polymer 261LV | 0.9 | $1.2 \times 10^8$ | 60 |
| 12. | 100% Polymer 261LV | 1.3 | $4.9 \times 10^7$ | 40 |
| 13. | 95% Polymer 261LV 5% Atomite | 0.9 | $9.1 \times 10^7$ | 60 |
| 14. | 100% 95% Polymer 261LV 5% Atomite | 1.2 | $5.3 \times 10^7$ | 40 |
| 15. | 100% 99.5% polymer 261LV 0.5% Zonyl FSB | 0.9 | $7.9 \times 10^7$ | 15 |
| 16. | 100.0% 99.5% Polymer 261LV 0.5% Zonyl FSB | 0.9 | $4.9 \times 10^7$ | 2 |
| 17. | 100.0% 94.5% Polymer 261LV 0.5% Zonyl FSB 5.0% Atomite | 0.9 | $8.1 \times 10^7$ | 15 |
| 18. | 100.0% 94.5% Polymer 261LV 0.5% Zonyl FSB 5.0% Atomite | 1.2 | $3.3 \times 10^7$ | 4 |
| 19. | 100.0% 90.0% Polymer 261LV 0.5% Zonyl FSB 9.5% Atomite | 0.9 | $1.4 \times 10^8$ | 15 |
| 20. | 100.0% 90.0% Polymer 261LV 0.5% Zonyl FSB 9.5% Atomite | 1.2 | $6.4 \times 10^7$ | 6 |
| 21. | 100.0% Top: 90.0% Polymer 261LV 0.5% Zonyl FSB 9.5% Atomite | 0.9 | $1.3 \times 10^8$ | 15 |
| | 100.0% | | | |

TABLE II

Conductivity and Solvent Holdout Properties of Paper Coated With 98/2 Polymer 261LV/Zonyl FSB in Methanol Solution

| Coating Formulation | C2S Total Coatweight Lbs./3000 Ft.$^2$ | Caliper (mil) | Surface Resistivity (Ohms/Square) 50% R.H. | Surface Resistivity (Ohms/Square) 18% R.H. | Volume Resistivity (Ohms-Inch) 50% R.H. | Volume Resistivity (Ohms-Inch) 18% R.H. | % Flaming Red Penetration |
|---|---|---|---|---|---|---|---|
| 17. | 1.58 | 3.2 | $1.4 \times 10^9$ | $1.2 \times 10^{11}$ | $7.9 \times 10^8$ | $3.3 \times 10^{11}$ | 60% |
| | | | $2.1 \times 10^9$ | $1.0 \times 10^{11}$ | | | 90% |
| 18. | 1.93 | 3.2 | $1.8 \times 10^9$ | $3.0 \times 10^{10}$ | $4.1 \times 10^8$ | $4.2 \times 10^{11}$ | 50% |
| | | | $7.9 \times 10^8$ | $5.3 \times 10^{10}$ | | | 80% |
| 19. | 2.25 | 3.2 | $4.9 \times 10^8$ | $3.0 \times 10^{10}$ | $3.1 \times 10^8$ | $2.2 \times 10^{11}$ | 20% |
| | | | $1.9 \times 10^9$ | $9.5 \times 10^{10}$ | | | 60% |
| 20. | 3.08 | 3.3 | $2.7 \times 10^8$ | $1.4 \times 10^{10}$ | $1.3 \times 10^8$ | $7.9 \times 10^{10}$ | 0% |
| | | | $7.0 \times 10^8$ | $2.1 \times 10^{10}$ | | | 10% |
| 21. | 3.28 | 3.3 | $2.5 \times 10^8$ | $1.2 \times 10^{10}$ | $1.5 \times 10^8$ | $9.2 \times 10^{10}$ | 0% |
| | | | $3.8 \times 10^8$ | $1.8 \times 10^{10}$ | | | 2% |

TABLE III

Conductivity and Solvent Holdout Properties of Raw Stock Coated with Polymer 261LV/Zonyl FSB/Atomite in Methanol Solution

| | Coating Formulation | Coat-weight Lbs./3000 Ft.$^2$ | Surface Resistivity at 50% R.H. (Ohms/Square) | % Flaming Red Penetration |
|---|---|---|---|---|
| 1. | 98% Polymer 261LV 2% Zonyl FSB | 1.1 | $7.5 \times 10^7$ | 0 |
| 2. | 100% 98% Polymer 261LV 2% Zonyl FSB | 1.4 | $6.1 \times 10^7$ | 0 |

TABLE III-continued

Conductivity and Solvent Holdout Properties of Raw Stock Coated with Polymer 261LV/Zonyl FSB/Atomite in Methanol Solution

| | Coating Formulation | Coat-weight Lbs./3000 Ft.$^2$ | Surface Resistivity at 50% R.H. (Ohms/Square) | % Flaming Red Penetration |
|---|---|---|---|---|
| | Back: | | | |
| | 90.0% Polymer 261LV | 1.2 | $2.2 \times 10^8$ | 50 |
| | 10.0% Atomite | | | |
| | 100.0% | | | |
| 22. | Top: | | | |
| | 90.0% Polymer 261LV | 1.2 | $9.1 \times 10^7$ | 1 |
| | 0.5% Zonyl FSB | | | |
| | 9.5% Atomite | | | |
| | 100.0% | | | |
| | Back: | | | |
| | 90.0% Polymer 261LV | 1.5 | $1.3 \times 10^8$ | 40 |
| | 10.0% Atomite | | | |
| | 100.0% | | | |
| 23. | 90.0% Polymer 261LV | 1.0 | $1.2 \times 10^8$ | 15 |
| | 0.5% Zonyl FSB | | | |
| | 9.5% Atomite | | | |
| | 100.0% | | | |
| 24. | 90.0% Polymer 261LV | 1.2 | $5.3 \times 10^7$ | 8 |
| | 0.5% Zonyl FSB | | | |
| | 9.5% Atomite | | | |
| | 100.0% | | | |
| 25. | Top: | | | |
| | 90.0% Polymer 261LV | 0.9 | $1.6 \times 10^8$ | 10 |
| | 0.5% Zonyl FSB | | | |
| | 9.5% Atomite | | | |
| | 100.0% | | | |
| | Back: | | | |
| | 90.0% Polymer 261LV | 1.2 | $1.6 \times 10^8$ | 40 |
| | 10.0% Atomite | | | |
| | 100.0% | | | |
| 26. | Top: | | | |
| | 90.0% Polymer 261LV | 1.2 | $1.1 \times 10^8$ | 2 |
| | 0.5% Zonyl FSB | | | |
| | 9.5% Atomite | | | |
| | 100.0% | | | |
| | Back: | | | |
| | 90.0% Polymer 261LV | 1.4 | $1.2 \times 10^8$ | 30 |
| | 10.0% Atomite | | | |
| | 100.0% | | | |
| 27. | 90% Polymer 261LV | 1.0 | $1.5 \times 10^8$ | 30 |
| | 10% Atomite | | | |
| | 100% | | | |
| 28. | 90% Polymer 261LV | 1.2 | $7.7 \times 10^7$ | 30 |
| | 10% Atomite | | | |
| | 100% | | | |
| 29. | Top: | | | |
| | 90.0% Polymer 261LV | 0.9 | $1.7 \times 10^8$ | 15 |
| | 0.5% Zonyl FSB | | | |
| | 9.5% Atomite | | | |
| | 100.0% | | | |
| | Back: | | | |
| | 90.0% Polymer 261LV | 1.3 | $2.3 \times 10^8$ | 40 |
| | 10.0% Atomite | | | |
| | 100.0% | | | |
| 30. | Top: | | | |
| | 90.0% Polymer 261LV | 1.3 | $1.2 \times 10^8$ | 2 |
| | 0.5% Zonyl FSB | | | |
| | 9.5% Atomite | | | |
| | 100.0% | | | |
| | Back: | | | |
| | 90.0% Polymer 261LV | 1.3 | $1.8 \times 10^8$ | 40 |
| | 10.0% Atomite | | | |
| | 100.0% | | | |
| 31. | 100% Polymer 261LV | 1.4 | $1.1 \times 10^8$ | 30 |
| 32. | 95% Polymer 261LV | 1.1 | $1.8 \times 10^8$ | 40 |
| | 5% Atomite | | | |
| | 100% | | | |
| 33. | Top: | | | |
| | 90.0% Polymer 261LV | 1.0 | $2.1 \times 10^8$ | 15 |
| | 0.5% Zonyl FSB | | | |
| | 9.5% Atomite | | | |
| | 100.0% | | | |
| | Back: | | | |
| | 90.0% Polymer 261LV | 0.9 | $2.0 \times 10^8$ | 60 |
| | 10.0% Atomite | | | |
| | 100.0% | | | |
| 34. | Top: | | | |
| | 90.0% Polymer 261LV | 1.1 | $1.7 \times 10^8$ | 2 |
| | 0.5% Zonyl FSB | | | |
| | 9.5% Atomite | | | |

TABLE III-continued

Conductivity and Solvent Holdout Properties of Raw Stock Coated with Polymer 261LV/Zonyl FSB/Atomite in Methanol Solution

| | Coating Formulation | Coat-weight Lbs./3000 Ft.$^2$ | Surface Resistivity at 50% R.H. (Ohms/Square) | % Flaming Red Penetration |
|---|---|---|---|---|
| | 100.0% | | | |
| | Back: | | | |
| | 90.0% Polymer 261LV | 1.2 | $1.1 \times 10^8$ | 30 |
| | 10.0% Atomite | | | |
| | 100.0% | | | |
| 35. | 90% Polymer 261LV | 1.0 | $1.2 \times 10^8$ | 40 |
| | 10% Atomite | | | |
| | 100% | | | |
| 36. | 90% Polymer 261LV | 1.2 | $9.4 \times 10^7$ | 30 |
| | 10% Atomite | | | |
| | 100% | | | |

Polymer 261LV is a low viscosity homopolymer of dimethyl diallyl ammonium chloride.

I claim:

1. A method for enhancing the solvent holdout properties of methanol soluble electroconductive coating formulations which comprises adding from about 0.5 to about 10% by weight of a methanol soluble or methanol dispersible fluorosurfactant of the formula:

$$F(CF_2)_nCH_2CH_2SCH_2CH_2N^+R_1R_2R_3$$

wherein:

n is an integer of from 4 to 14;

$R_1$ is an alkyl group of 1 to 4 carbon atoms;

$R_2$ is an alkyl group of 1 to 4 carbon atoms; and $R_3$ is an alkyl group of 1 to 4 carbon atoms or is the covalently bonded anion to a coating formulation comprising from 60 to about 99% by weight of an electroconductive cationic quaternary ammonium polymer selected from the group consisting of poly-(dimethyldiallylammonium chloride), a copolymer of dimethyl diallyl ammonium chloride and diacetone acrylamide containing from 70 to 98% of diallyl monomer units, polyvinyl benzyl trimethyl ammonium chloride, polymethacryloloxyethyl trimethyl ammonium chloride, polymethacryloloxyethyl trimethyl ammonium methosulfate, polyepichlorohydrin 80 to 100% quaternized with trimethylamine, copolymers of acrylamide and methacryloloxyethyl trimethyl ammonium chloride containing from 90 to 99.5% methacryloloxyethyl monomer, and poly-(methacryloloxyethyl dimethyl hydroxyethyl ammonium chloride) and 0 to about 40% by weight of a pigment.

2. A method as in claim 1 wherein the electroconductive polymer is a homopolymer of dimethyl diallyl ammonium chloride.

3. A methanol soluble electroconductive coating formulation comprising from 60 to about 99% by weight of an electroconductive cationic quaternary ammonium polymer selected from the group consisting of poly-(dimethyldiallylammonium chloride), a copolymer of dimethyl diallyl ammonium chloride and diacetone acrylamide containing from 70 to 98% of diallyl monomer units, polyvinyl benzyl trimethyl ammonium chloride, polymethacryloloxyethyl trimethyl ammonium chloride, polymethacryloloxyethyl trimethyl ammonium methosulfate, polyepichlorohydrin 80 to 100% quaternized with trimethylamine, copolymers of acrylamide and methacryloloxyethyl trimethyl ammonium chloride containing from 90 to b 99.5% methacryloloxyethyl monomer, and poly-(methacryloloxyethyl dimethyl hydroxyethyl ammonium chloride), 0 to about 40% by weight of a pigment and from about 0.5 to about 10% by weight of a methanol soluble fluorosurfactant of the formula:

$$F(CF_2)_nCH_2CH_2SCH_2CH_2N^+R_1R_2R_3$$

wherein:

n is an integer of from 4 to 14;

$R_1$ is an alkyl group of 1 to 4 carbon atoms;

$R_2$ is an alkyl group of 1 to 4 carbon atoms; and $R_3$ is an alkyl group of 1 to 4 carbon atoms or is the covalently bonded anion.

4. A method as in claim 3 wherein the electroconductive polymer is a homopolymer of dimethyl diallyl ammonium chloride.

* * * * *